US005243943A

United States Patent [19]

Bofinger et al.

[11] Patent Number: 5,243,943

[45] Date of Patent: Sep. 14, 1993

[54] FUEL INJECTION PUMP

[75] Inventors: Günter Bofinger, Vaihingen; Heinz Nothdurft, Stuttgart; Karl-Friedrich Rüsseler, Ditzingen; Josef Hain, Leonberg; Hubertus Zedler, Nussdorf; Manfred Narr-Hess, Fellbach, all of Fed. Rep. of Germany; Rémy Schmitt, Catou, France

[73] Assignee: Robert Bosch GmbH, Stuttgart, Fed. Rep. of Germany

[21] Appl. No.: 867,109

[22] PCT Filed: Nov. 24, 1990

[86] PCT No.: PCT/DE90/00908

§ 371 Date: Aug. 18, 1992

§ 102(e) Date: Aug. 18, 1992

[87] PCT Pub. No.: WO91/10056

PCT Pub. Date: Jul. 11, 1991

[30] Foreign Application Priority Data

Dec. 29, 1989 [DE] Fed. Rep. of Germany ..... 3943246

[51] Int. Cl.[5] ..... F02M 37/04

[52] U.S. Cl. ..... 123/502; 123/449

[58] Field of Search ..... 123/502, 449, 458, 500, 123/501

[56] References Cited

U.S. PATENT DOCUMENTS

| | | | |
|---|---|---|---|
| 2,910,975 | 11/1959 | Evans | 123/502 |
| 3,486,492 | 12/1969 | Lehnerer | 123/502 |
| 3,633,559 | 1/1972 | Eheim | 123/502 |
| 4,502,449 | 3/1985 | Laufer | 123/502 |
| 4,589,394 | 5/1986 | Ito | 123/502 |
| 4,619,238 | 10/1986 | Hain | 123/502 |
| 4,733,645 | 3/1988 | Hain | 123/502 |
| 4,796,592 | 1/1989 | Hofer | 123/502 |
| 5,033,441 | 7/1991 | Hain | 123/502 |
| 5,188,083 | 2/1993 | Reisser | 123/502 |

FOREIGN PATENT DOCUMENTS

| | | | |
|---|---|---|---|
| 2057165 | 3/1981 | United Kingdom | 123/502 |

*Primary Examiner*—Carl S. Miller
*Attorney, Agent, or Firm*—Michael J. Striker

[57] ABSTRACT

A distributor-type fuel injection pump is provided with a hydraulic injection adjusting mechanism whose injection adjusting piston adjusts the cam gear unit for driving the pump plunger to execute strokes corresponding to the desired position of the start of injection. The injection adjusting piston defines a control space on one side and a spring space receiving a return spring on the other side. The control space is connected via a throttle bore with the pump interior space which is filled with fuel by a delivery pump. The fuel pressure is adjusted by a pressure control valve. To prevent unstable pressure vibrations on the injection adjusting piston, which leads to defects in the operation of the fuel injection pump, the spring space is connected on one side with the suction side of the delivery pump via a first throttle and on the other side with the pressure side of the delivery pump via a second throttle having a smaller throttle cross section.

4 Claims, 1 Drawing Sheet

FUEL INJECTION PUMP

BACKGROUND OF THE INVENTION

The present invention relates to a fuel injection pump for internal combustion engines.

More particularly, it relates to a fuel injection pump for internal combustion engines, which has a pump interior space constructed in a pump housing, a fuel delivery pump sucking fuel out of a fuel tank and delivering it into the pump interior space, a pressure control valve adjusting the fuel pressure in the pump interior space with a pump plunger executing at least an axial stroke movement, sucking the fuel out of the pump interior space during a suction stroke and apportioning the fuel injection pressure to at least one injection line during a delivery of a pressure stroke, a drive shaft rotating in a pump housing and driving the pump plunger to execute at least a stroke movement via a cam gear unit, and a hydraulic injection and adjusting mechanism for adjusting the start of the delivery stroke of the pump plunger with respect to the rotational position of the drive shaft and also with a control space and a spring space.

Such fuel injection pumps are known e.g. from GB 2 017 350 or DE 36 05 452 A1. Practical experience with these fuel injection pumps shows that unstable pressure vibrations frequently occur in the spring space of the hydraulic injection timing or adjusting mechanism used in such fuel injection pumps. These pressure vibrations trigger instability in the adjusting path of the injection adjusting piston, which results in defects in the operation of the fuel injection pump due to its displacing action on the cam gear unit.

SUMMARY OF THE INVENTION

Accordingly, it is an object of the present invention to provide a fuel injection pump for internal combustion engines which avoids the disadvantages of the prior art.

In keeping with these objects and with others which will become apparent hereinafter, one feature of the present invention resides, briefly stated, in a fuel injection pump in which the spring space of the injection adjusting mechanism is connected to a pressure-side outlet of the fuel delivery pump via a second throttle, and the throttle cross-section of the second throttle is dimensioned so as to be smaller than the throttle cross-section of the first throttle between the spring space and the suction side inlet of the fuel delivery pump.

When the fuel injection pump is designed in accordance with the present invention, it has the advantage that a partial flow of fuel reaches the spring space by means of the throttled coupling of the spring space of the injection adjusting mechanism with the delivery or pressure side of the delivery pump and builds up a pressure level in the spring space which stabilizes pressure vibrations. An improvement in the injection adjusting function of the injection adjusting mechanism is accordingly achieved with respect to linearity, reproducibility and stability of the adjustment of the commencement of injection. For this purpose the spring space is partially uncoupled from the suction side of the delivery pump via a first throttle and is connected to the outlet of the delivery pump on the pressure side via a second throttle The throttle cross section of the first throttle is selected so as to be larger than that of the second throttle A good stabilization is achieved when the first throttle has a bore diameter of approximately 0.9 mm and the second throttle has a bore diameter of approximately 0.6 mm.

In a preferred embodiment form of the invention the throttled coupling of the spring space with the pressure side of the delivery pump is realized in a particularly advisable manner in that the throttle bore is introduced into the pressure piston of the pressure control valve and connects the pressure and spring chambers of the pressure piston. Thus, the spring chamber of the pressure control valve is not connected with the suction side of the delivery pump as was previously the case, but rather with the spring space of the injection adjusting mechanism. The necessary constructional modifications to the standard pump are accordingly minimal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT EXAMPLE

Figure 1:
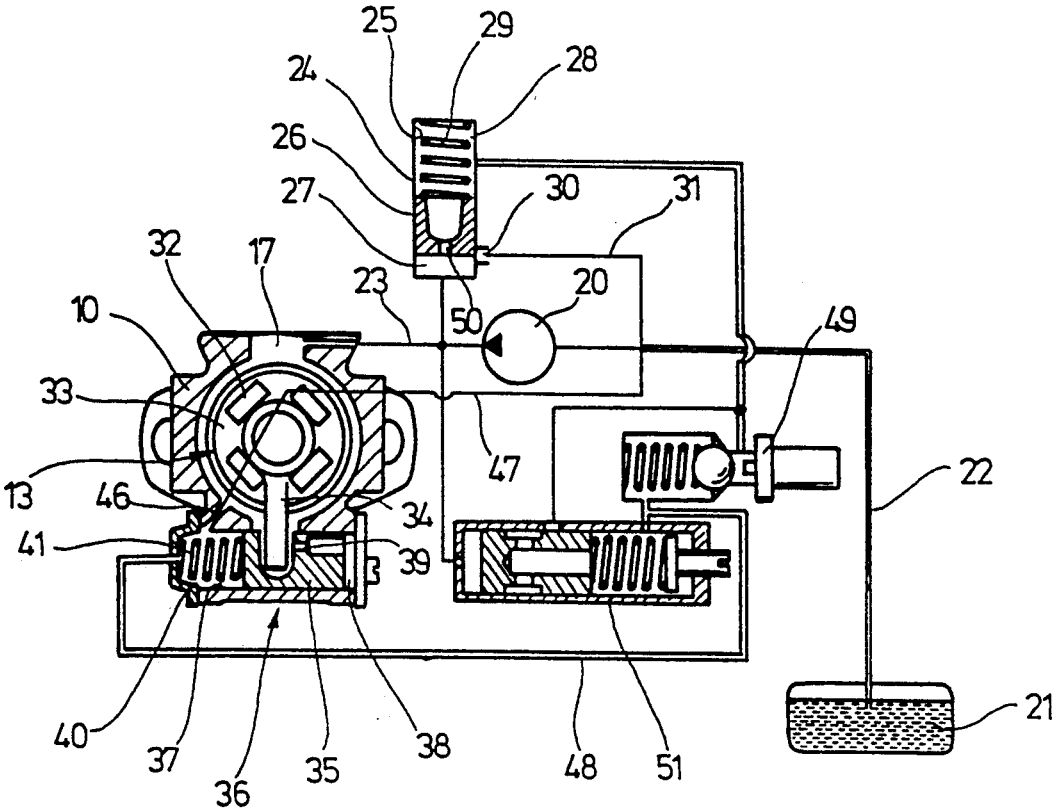
FIG. 1 is a schematic view of a fuel injection pump for an internal combustion engine.
Figure 2:
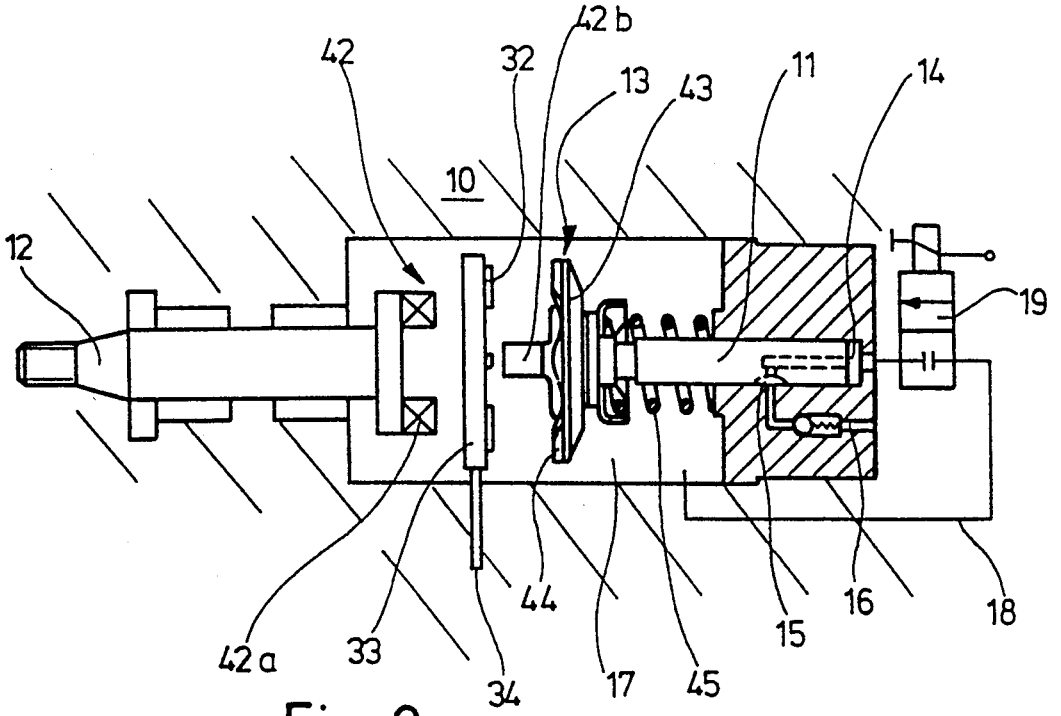
FIG. 2 is a schematic view of the drive shaft, cam gear unit and pump plunger of the fuel injection pump in FIG. 1 which is turned by 90° in the drawing plane relative to FIG. 1.

In the distributor-type fuel injection pump shown schematically in FIGS. 1 and 2 a pump plunger 11, also serving as a distributor, is set in reciprocating motion and in a rotating movement simultaneously by a drive shaft 12 and by a cam gear unit 13. With each pressure stroke of the pump plunger 11 fuel is delivered from a pump work space 14 defined by the pump plunger 11 via a distributor slot 15 to one of a plurality of pressure ducts 16 which are arranged around the pump plunger 11 so as to be uniformly spaced along the angle of rotation and lead in each instance to an injection valve assigned to a combustion chamber of the internal combustion engine. The pump work space 14 is filled with fuel which is sucked out of a pump interior space 17 in the pump housing 10 with each suction stroke of the pump plunger 11 and brought to injection pressure during the pressure stroke. The injection process is terminated when a magnet valve 19 arranged in a relief line 18 between the pump work space 14 and pump interior space 17 or a slide on the pump plunger, not shown here, opens the relief line which then leads through the pump plunger. The pump interior space 17 is supplied with fuel by a delivery pump 20 which sucks fuel out of a fuel tank 21 via a suction line 22 and delivers it to the pump interior space 17 via a pressure line 23. The delivery pump 20 is generally driven by the drive shaft 12, but can also have a separate electric motor. The output pressure of the delivery pump 20 and accordingly the fuel pressure in the pump interior space 17 are controlled by a pressure control valve 24. This pressure increases corresponding to a desired function as the rate of rotation of the drive shaft 12 increases. For this purpose the pressure control valve 24 has a pressure piston 26 which is displaceable in a bore hole 25 and which, with one end face, defines a pressure chamber 27 connected with the pressure line 23 and, with its other end face, defines a spring chamber 28, a return spring 29 supported at the base of the bore hole and at the pressure piston 26 being received in the spring chamber 28. When pressure is built up in the pressure chamber 27, the pressure piston 26 is displaced against the force of the return spring 29 and progressively opens a relief opening 30 toward the suction side of the delivery pump 20, which relief opening 30 is connected with the suction line 22 via a relief line 31.

The cam gear unit 13, in a known manner, has a roller ring 33 supporting a roller 32, which roller ring 33 is supported in the pump housing 10 so as to be rotatable at a determined angle and is coupled via an adjusting pin 34 with an injection adjusting piston 35 of an injection adjusting mechanism 36 so as to be fixed with respect to rotation relative to it. One end face of the injection adjusting piston 35 which is axially displaceable in a bore hole 37 in the pump housing 10 tangential to the roller ring 33 defines a control space 38 which is connected with the pump interior space 17 via a throttle duct 39. The other end face of the injection adjusting piston 35 defines a spring space 40 which receives a return spring 41 which is supported at the base of the bore hole on one side and at the injection adjusting piston 35 at the other side. As the fuel pressure in the pump interior space 17 increases with increasing speed, the pressure in the control space 38 also increases and displaces the injection adjusting piston 35 against the force of the return spring 41 so that the roller ring 33 is rotated. There is a claw coupling 42 in the inner bore hole of the roller ring 33 in which claws **42*a* at the drive shaft 12 engage with claws 42*b* at the pump plunger 11 via a cross-plate, not shown, so as to be fixed with respect to rotation relative to one another, therefore the pump plunger 11 can additionally execute a stroke movement during rotation independently of the drive shaft 12. A front cam or eccentric disk 43 is fastened at the pump plunger 11. The surface of the front cam or eccentric disk 43, which carries protuberances or front cams 44, runs over the roller 32 of the roller ring 33. The number of front cams 44 corresponds to the number of pressure ducts 16. The contact pressure force of the front cams 44 at the rollers 32 is applied by a contact pressure spring 45. When the injection adjusting piston 35 is displaced against the return spring 41, the roller ring 33 is rotated so that the front cams 44 of the eccentric disk 43 achieve engagement with the rollers 32 earlier with respect to the rotational position of the drive shaft 12. Thereby the beginning of the stroke of the pump plunger 11 and accordingly the start of delivery of the fuel and the start of injection is effected earlier with respect to the rotational position of the drive shaft 12. Thus, the higher the fuel pressure in the pump interior space 17, and accordingly the higher the control pressure at the injection adjusting piston 35**, the sooner the start of injection.

The spring space 40 of the injection adjusting mechanism 36 is connected with the suction side of the delivery pump 20 via a first throttle 46, which is illustrated in FIG. 1 by a connection line 47 shown schematically. Further, the spring space 40 of the injection adjusting mechanism 36 is connected with the spring chamber 28 of the pressure control valve 24 via a second connection line 48. A seat valve 52 is connected in this connection, which seat valve 52 is controlled by an expansible element 49 and opens above a predetermined value of the coolant temperature of the internal combustion engine and accordingly releases the second connection line 48. The spring chamber 28 of the pressure control valve 24 is connected with the pressure side of the delivery pump 20 via a second throttle 50. The second throttle 50 is advisably constructed as an axial throttle bore which completely penetrates the pressure piston 26 and connects the pressure chamber 27 of the pressure control valve 24 with the spring chamber 28. The throttle cross section of the second throttle 50 is kept smaller than the throttle cross section of the first throttle 46. In a preferred embodiment form, the bore diameter of the first throttle 46 is 0.9 mm and the bore diameter of the second throttle is 0.6 mm. As a result of the spring space 40 of the injection adjusting mechanism 36 being uncoupled from the suction side of the delivery pump 20 by the first throttle 46, and as a result of the throttled connection of the spring space 40 to the pressure side of the delivery pump 20 effected via the second throttle 50, a reaction pressure acting against the pressure in the control space 38 of the injection adjusting mechanism 36 is built up in the spring space 40. It stabilizes the pressure vibrations in the spring space 40 of the injection adjusting piston 35. The operation of the injection adjusting mechanism 36 is accordingly substantially improved with respect to linearity, reproducibility and stability of the injection adjustment.

A cold start accelerator (KSB) 51, which is known per se and is constructed in this instance as a hydraulic KSB 51, is conventionally provided in the fuel injection pump. It comprises the thermostatically controlled seat valve 49 and a pressure limiting valve 53 which is arranged in a parallel line 54 to the seat valve 49 and opens the latter when a determined interior pressure is achieved. The relief of the spring space 28 is prevented by the seat valve 49 when starting with a cold internal combustion engine and in the warm-running phase so that the pressure prevailing in the interior of the fuel injection pump comes into play and the relief opening 30 is closed by the piston 26. Thus, the interior pressure increases and causes a displacement of the injection adjusting piston 35 in the direction of an early commencement of injection. The magnitude of the injection adjustment is limited by the pressure limiting valve 53 as the speed and interior space increase.

The shifting of the start of injection in the "early" direction in the cold phase of the internal combustion engine is reinforced in that the KSB 51 switches on a throttle in the second connection line 48, which throttle has a throttle cross section which is small at first and which increases as the pressure increases in the pump interior space 17, so that the counterpressure building up in the spring space 40 of the injection adjusting mechanism 36 remains relatively low and a lower pressure in the control space 38 is sufficient to displace the injection adjusting piston 35 against the return spring 41.

It will be understood that each of the elements described above, or two or more together, may also find a useful application in other types of constructions differing from the types described above.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A fuel injection pump for internal combustion engines, comprising a pump housing forming a pump interior space; a fuel tank; a fuel delivery pump sucking fuel out of said fuel tank and delivering it into said pump interior space; a pressure control valve adjusting a fuel pressure in said pump interior space and having a pump plunger which executes at least an axial stroke movement, sucks the fuel out of said pump interior space during a suction stroke, and apportions the fuel under injection pressure to at least one injection line during a delivery or pressure stroke; a cam gear unit; a drive shaft which rotates in said pump housing and drives said pump plunger to execute at least a stroke movement via said cam gear unit; a hydraulic injection adjusting mechanism for adjusting the start of the delivery stroke of the pump plunger with respect of a rotational position of said drive shaft, said hydraulic injection adjusting mechanism having an injection adjusting piston acting on said cam gear unit; a control space defined by one end face of said injection adjusting piston and connected with said pump interior space; a throttle bore which controls said control space with said pump interior space; a spring space which is defined by the other end face of said pump plunger and connected with a suction side of said fuel adjusting piston; a throttle via which said spring space is connected with said suction side of said fuel delivery pump; a return spring which is received in said spring space and supported at said injection adjusting piston; a second throttle connecting said spring space of said injection adjusting mechanism to a pressure-side outlet of said fuel delivery pump, said second throttle having a throttle cross-section dimensioned so as to be smaller than a throttle cross-section of said first mentioned throttle between said spring space and said suction-side inlet of said fuel delivery pump.

2. A fuel injection pump as defined in claim 1, wherein said pressure control valve has a pressure piston which defines a pressure chamber connected to said pressure-side outlet of said fuel delivery pump and a spring chamber; and further comprising a return spring received in said spring chamber, said spring chamber progressively opening a relief opening toward said suction side of said delivery pump when displaced axially against a force of said return spring.

3. A fuel injection pump as defined in claim 2, wherein said second throttle is formed as a throttle bore which penetrates said pressure piston axially and connects said pressure chamber and said spring chamber with one another, said spring chamber being connected with said spring space of said injection adjusting mechanism.

4. A fuel injection pump as defined in claim 1, wherein said first mentioned throttle has a bore diameter approximately 0.9 mm, said second throttle having a bore diameter of approximately 0.6 mm.

* * * * *